US005513781A

United States Patent [19]

Ullrich et al.

[11] Patent Number: 5,513,781

[45] Date of Patent: May 7, 1996

[54] PERFORATED INNER SEAL AND LINER ASSEMBLY FOR CLOSURES AND METHOD OF MAKING SAME

[75] Inventors: Jeffrey F. Ullrich, Western Springs; Albert R. Miller, Hinsdale, both of Ill.

[73] Assignee: Phoenix Closures, Inc., Naperville, Ill.

[21] Appl. No.: 279,190

[22] Filed: Jul. 22, 1994

[51] Int. Cl.[6] ..... B65D 53/04

[52] U.S. Cl. ..... 222/565; 215/232; 215/347

[58] Field of Search ..... 222/480, 565, 222/542; 215/232, 341, 347, 349, 258, 261; 220/265, 258, 256, 359; 29/428

[56] References Cited

U.S. PATENT DOCUMENTS

| | | | |
|---|---|---|---|
| 142,963 | 9/1873 | Tenny | 222/565 X |
| 1,068,446 | 7/1913 | Pullen et al. | 222/565 X |
| 2,646,183 | 7/1953 | Pellett | 215/347 |
| 2,715,474 | 8/1955 | Phillips | 215/347 |
| 3,101,877 | 8/1963 | Driscoll | 222/548 X |
| 3,968,823 | 7/1976 | Simon | 220/306 |
| 4,013,188 | 3/1977 | Ray | 215/347 |
| 4,020,969 | 5/1977 | Ando | 220/265 |
| 4,280,653 | 7/1981 | Elias | 215/233 X |
| 4,588,099 | 5/1986 | Diez | 215/232 |
| 4,596,338 | 6/1986 | Yousif | 215/232 |
| 4,771,937 | 9/1988 | Kamada et al. | 229/123.1 |
| 4,784,885 | 11/1988 | Carespodi | 428/36.8 |
| 5,012,946 | 5/1991 | McCarthy | 215/232 X |
| 5,176,271 | 1/1993 | Painchaud et al. | 215/232 X |
| 5,184,746 | 2/1993 | Moore et al. | 222/565 X |
| 5,197,618 | 3/1993 | Goth | 215/232 |
| 5,265,745 | 11/1993 | Pereyra et al. | 215/232 |
| 5,381,913 | 1/1995 | Peeters | 215/232 |
| 5,433,992 | 7/1995 | Galda et al. | 215/232 X |

*Primary Examiner*—Kevin P. Shaver
*Attorney, Agent, or Firm*—Welsh & Katz, Ltd.

[57] ABSTRACT

A sifter and liner assembly and method of making the assembly which is configured for use with a container. The sifter is dimensioned to span the mouth of the container and has an upper surface, a lower surface and a least one aperture. The liner is dimensioned to cover at least the aperture of the sifter and includes an integral pull tab. A layer of permanent adhesive material is located on a peripheral edge of the lower surface of the sifter to secure the sifter to the lip of the container. A layer of impermanent adhesive material is located between the sifter and the liner for removably securing the liner to the sifter. The sifter and liner are retained together within the closure cap. The sifter, liner and closure cap form a package which can be stored, transported and applied to the container as a unit.

17 Claims, 2 Drawing Sheets

PERFORATED INNER SEAL AND LINER ASSEMBLY FOR CLOSURES AND METHOD OF MAKING SAME

The present invention relates to a sifter fitment and a peel-away liner which is assembled as a unit into a closure cap and the method of making same.

BACKGROUND OF THE INVENTION

The bottling industry continuously seeks innovations that will increase speed and lower costs, especially in the area of sifter fitments and protective peel-away liners. Typically, containers used for products such as spices utilize a sifter to allow a controlled dispensing of the product. The sifters are usually made of paper, plastic or foil and are often snapped onto the container mouth once the container has been filled with the given product. In conventionally available dispensing packages, a protective peel-away liner is adhered to the lip of the container mouth to protect the contents of the container and to perform a tamper-indicating function then a sifter is mounted to the container mouth over the liner. Finally, a closure cap will be applied to the container mouth, over the sifter and liner. Accordingly, to gain access to the contents of the container, the end user must remove the closure cap, then snap off the sifter fitment, peel off the protective liner, snap the sifter fitment back on the container and then invert the container to allow the contents to pour through the apertures in the sifter.

With conventional dispenser packages, the user must, therefore, remove and replace the sifter to the container before being able to access the container's contents. Often the user will find it difficult, and sometimes impossible, to remove the sifter from the container, since they are usually tightly snapped over the mouth of the container. A knife or other tool must then be utilized as leverage to snap the sifter off the container in order to peel away the protective liner. Particularly, elderly and physically challenged individuals find the conventional dispenser packages difficult to use.

Further, conventional dispenser packages add to the expense of the product since they are costly and time consuming to manufacture and assemble especially when utilizing plastic sifter fitments.

SUMMARY OF THE INVENTION

It is, therefore, an object of the present invention to provide a sifter and liner assembly, which can be applied as a unit within a closure cap and which can subsequently be applied to a container quickly and precisely.

Another object of the present invention is to provide an economical sifter and liner package that provides for the sifter to be directly applied to the container mouth and the liner to be directly applied to the upper surface of the sifter.

Another object of the present invention is to provide a method of forming and applying the present sifter and liner assembly onto a container.

In accordance with the present invention, all of these objects, as well as others not herein identified, are achieved generally by the present sifter and liner assembly, wherein the sifter and fitment are formed independently but are applied together to create a single unit which can then be mounted into a closure cap for transportation to the bottler and application to the given container. The fitment and liner assembly is designed for simple preassembly and application to a container with the closure cap.

More specifically, the present invention includes a closure cap and a sifter and liner assembly configured for use with a container having a neck with an annular lip at its uppermost end defining a mouth. The sifter has an upper and lower surface through which a plurality of apertures are formed to allow the controlled egress of the container contents. The sifter is adhered directly to the mouth of the container without any protective liner coming between it and the mouth. The sifter can be formed to include on its lower surface, a layer of permanent adhesive material which upon heat induction or conduction (referred to hereinafter as "heat activated") will adhere to the mouth of the container. Likewise, a pressure sensitive material can be used. The upper surface of the sifter has adhered to it, with a nonpermanent adhesive material, a peel-away liner that adheres to the upper surface of the sifter. The peel-away liner has a pull-tab formed integrally therewith and is dimensioned to substantially cover the sifter layer. The sifter and peel-away layers are mountable as a unit within a given closure cap to form a package including the sifter, peel-away liner and closure cap. This package can then be sold, distributed and stored together as a single unit until application to the given container.

The bottler can thereafter assemble the closure cap containing the sifter and peel-away liner onto a container and through a number of given methods, such as heat induction, cause the adhesive materials on the lower surface of the sifter and between the upper surface of the sifter and the peel-away liner to adhere to their respective predetermined surfaces. Accordingly, in production, the closure cap will be applied to the container and thereafter the adhesive materials applied to the lower surface of the sifter and between the sifter and peel-away liner can be activated, such as through heat induction or application of pressure, quickly and easily.

BRIEF DESCRIPTION OF THE DRAWINGS

Further objects of the invention, taken together with additional features contributing thereto and advantages occurring therefrom, will be apparent from the description of invention when read in conjunction with the accompanying drawings, wherein.

DETAILED DESCRIPTION OF THE INVENTION

Figure 1:
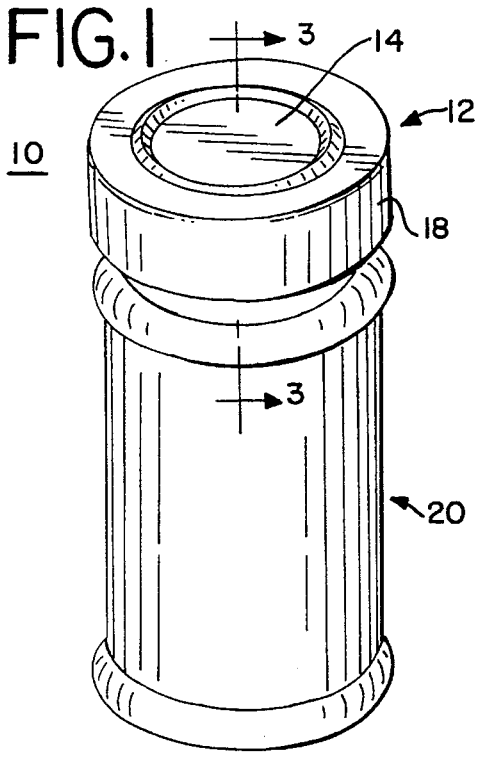
FIG. 1 is a perspective view of the present assembly.
Figure 2:
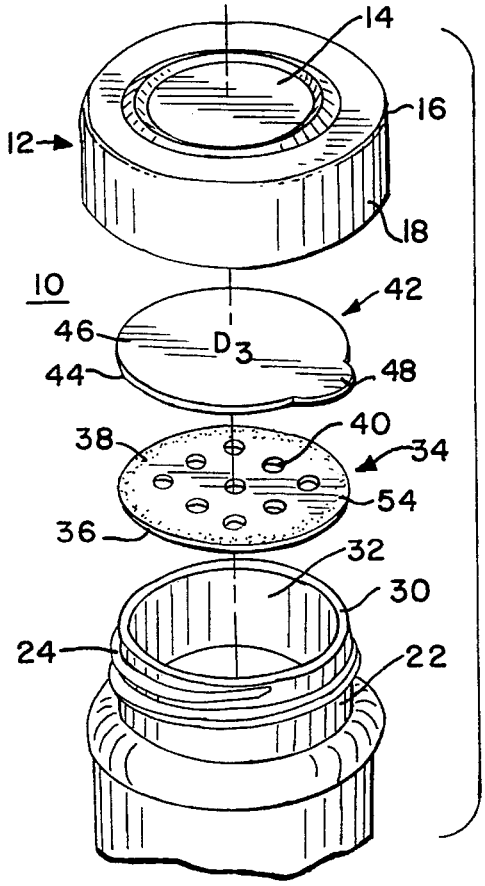
FIG. 2 is an exploded view of the present invention depicting the sifter, liner and closure removed from the container.
Figure 3:
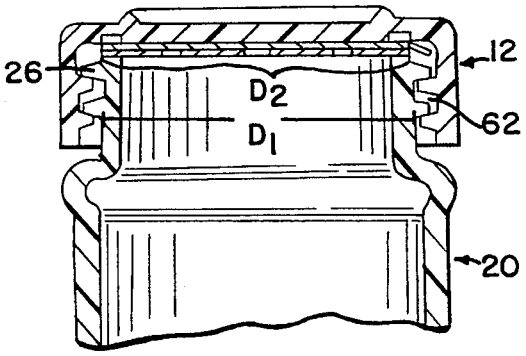
FIG. 3 is a frontal sectional view of the present invention as applied to a container taken along lines 3—3 of FIG. 1.

In the drawings, namely FIGS. 1 through 3, wherein a preferred embodiment of the invention is shown, and wherein similar reference characters designate corresponding parts throughout the several views, 10 generally designates the present closure, sifter and peel-away liner assembly. It is contemplated that the closure cap 12 will be manufactured of any conventional plastic material used for molded closures, such as polypropylene or polyethylene. More particularly, the closure cap 12 includes a top panel 14, a peripheral edge 16 and a depending annual skirt 18 integral with the edge 16.

The closure, sifter and peel-away liner assembly 10 is typically designed for use with any type of container 20 that is commonly used for storing and dispensing granular or powdered substances, liquids or other substances where it is preferred to have controlled egress of the given product. Although a specific type of container is not required for use with the present closure 10, it is contemplated that the container 20 will include a container neck 22, which may include external threading 24 designed to engage complimentary threading 26 on the inside surface 28 of the closure 12. The neck 22 terminates at an upper end in an annular lip 30, which defines the container mouth 32. The opening created by the container mouth 32 into the container has a given diameter "$D_1$".

The sifter layer 34 typically has a lower surface 36, an upper surface 38 and at least one and preferably several sifter dispensing apertures 40 formed through the lower and upper surfaces 36 and 38. The apertures 40 can be designed to meet the flow requirements for specific products. The sifter 34 is preferably made of an aluminum foil or other inexpensive material which can be easily stamped, such as with a punch press, to form a sifter of diameter $D_2$ having apertures 40. Accordingly, although paper, polypropylene or polyethylene materials are contemplated for use in forming the sifter layer 34, it should be understood that other suitable materials can be used without departing from the nature of the invention. The diameter $D_2$ of the sifter 34 is preferably equal to the diameter $D_1$ of the container mouth 32. The diameter of the apertures 40 must be large enough to allow the contents of the container to be shaken out by the user thereby controlling the flow of the contents without completely obstructing or blocking its egress. It is contemplated that the sifter 34 could also be manufactured from paper, plastic or other suitable materials.

Figure 4:
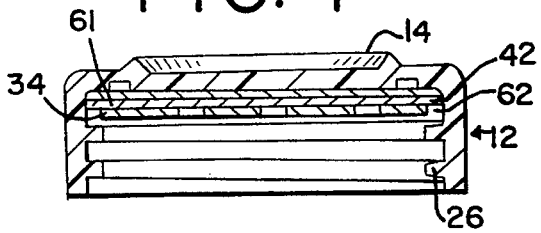
FIG. 4 is a frontal sectional view taken along lines 3—3 of FIG. 1 of the present assembly with the sifter and liner retained within the closure to form a package.
Figure 5:
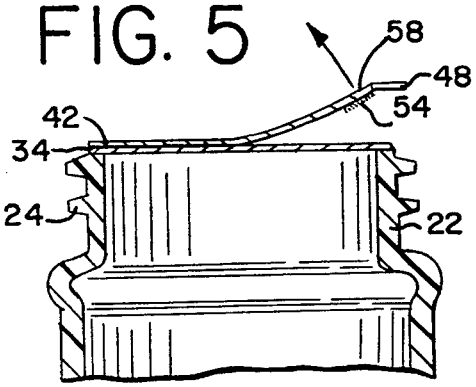
FIG. 5 is a frontal sectional view of the present invention depicting the liner partially removed from the sifter.
Figure 6:
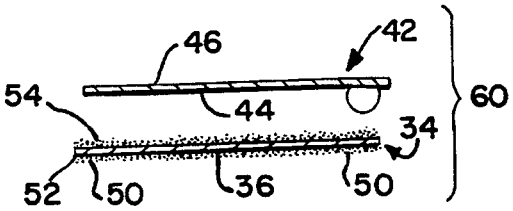
FIG. 6 is a frontal sectional view of the sifter and the liner.

Referring to FIGS. 3, 4 and 6, the peel-away liner 42 has a lower surface 44, upper surface 46 and an integral pull-tab 48. The peel-away liner 42 is preferably made of a foam polypropylene, but can also be made of polyethylene or paper material which can be easily formed, such as with a punch press, to have a diameter $D_3$ and the integral pull-tab 48. The diameter $D_3$, as with the diameter $D_2$, will preferably be substantially equal to the diameter $D_1$ of the mouth 32. The peel-away liner 42 serves to protect the contents of the container 12 as well as providing a tamper indicating function. As shown in FIG. 5, the peel-away liner 42 must be removed by the consumer in order to gain access to the container contents.

As shown most clearly in FIGS. 2, 3, 5 and 6, the sifter 34 and peel-away liner 42 also include on selected surfaces, adhesive material which is used to adhere the layers in a predetermined fashion. First, on the lower surface 36 of the sifter 34 there is included a layer of permanent adhesive material 50 such as a heat sealable polyester film or a heat sealable polyethylene film, as well-known in the art. The permanent adhesive material 50 should be applied to cover substantially the entire lower surface 36. However, because the sifter 34 includes apertures 40 it may be decided that the layer of permanent adhesive material 50 be applied sparingly and only along the outermost periphery 52 of the sifter 34. Furthermore, the permanent adhesive material 50 must be positioned on the lower surface 36 of the sifter 34 so as to at least correspond to the annular lip 30 of the container 20 in order that the adhesive material adheres properly to the container mouth 32. It has been found that 3M Corporation's Safeguard® 90, a heat sealable polyester film, and Selig Sealing Products, Inc.'s (Oakbrook Terrace, Ill.) Foilseal™ M-1, a heat sealable polyethylene film, are suitable examples of materials for this application.

The material used for adhesive layers 50 and 54 is preferred to be of the type used in heat activated sealing, including heat sealable polyolefin materials such as EVA, polyethylene, polypropylene, PVC, etc., depending on the container composition to be sealed and the heat method applied. Alternatively, it should also be understood that other types of materials used to glue the sifter 34 to the lip 30 or pressure sensitive materials can be substituted without departing from the nature of the invention.

As shown in FIGS. 2 and 5, there is a second layer of adhesive material 52 which is applied to the its upper surface 38 of sifter 34, or alternatively to the lower surface 44 of the peel-away liner 42. The layer of adhesive material 54 should be of a type creating a less aggressive band than the material 50, such that the peel-away liner 42 can be easily removed by the end user of the container to gain access to the container contents. To this end, Selig Sealing Products, Inc.'s Foilseal™ 1–18, a heat sealable polyolefin film, has been found to work in the application of this invention.

Again, as with the permanent adhesive material layer 50, it may be preferred that the layer 54 be applied sparingly so that it does not interfere or obstruct the apertures 40. Additionally, since cost effectiveness is always a concern, it may be beneficial to use less amounts of adhesive material. It is important to realize that the specific type of material used for sifter 34, peel-away liner 42 or adhesive material layers 50 or 54 can be varied while keeping within the principals disclosed herein.

The purpose of the peel-away liner 42 is to cover the apertures 40 of the sifter 34. The peel-away liner 42 also performs numerous secondary functions such as, but not limited to, maintaining the freshness of the product by covering the apertures 40, acting as an indicator of tampering, and lastly, as a surface for carrying a given message regarding recipes, discounts, advertising, etc.

Preferably, the sifter 34 will be from 0.0003 to 0.003 mils of aluminum foil, whereas the adhesive layers 50 and 54 will normally be from 0.0005 to 0.0035 mils of adhesive material. The layer 54 of adhesive material which is actually sandwiched between the sifter 34 and peel-away liner 42 can be of a material which is adhesive without needing heat activation such as glue or pressure sensitive material.

Therefore, the configuration of the present invention consists namely of a sifter 34 having on its lower surface 36 a permanent or aggressive adhesive material, and sandwiched between the lower surface 44 of the peel-away liner 42 and the upper surface 38 of the sifter 34 is a less aggressive adhesive layer 54. The layers 34, 42, 50 and 54 form a package 60, as shown in FIGS. 4 and 6, that can be placed into a retaining area 62 inside the closure cap 12. Additionally, if required, a secondary liner 61 can be included in the package 60 to maintain the freshness of the container contents once the peel-away liner 42 has been removed. In this respect, we have found that the SURE-SEAL® liner manufactured by Phoenix Closures, Inc. is preferable for use in conjunction with this invention.

As shown in FIG. 4, the package 60 will be held up within the retaining area 62 such as through a frictional fit or by adhering it into the retaining area 62 so that it does not become dislodged or lost during storage, transport or during the application process. To this end, the threads 26 of the closure 12 form an interference structure above which the package 60 can be mounted and removably secured. Further, it is contemplated that tab 48 will need to be folded over upon the upper surface 46 of the peel-away liner 42 so that it does not interfere or obstruct the proper placement of the package 60 up within the retaining area 62 or onto the container mouth 32. Alternatively, as shown in FIG. 3, the tab 48 can be left free to depend down into the retaining area 62. Since the package 60 fits within the retaining area 62, it can be transported as a unit together with the closure 12 to the bottler. The bottler can then apply both the closure cap and the package onto the container quickly and easily.

Once the closure, sifter and peel-away liner 10 are applied onto the container 20, such as shown in FIG. 3, an available heat activation sealing method can be applied to the closure in order to activate the adhesive layers 50 and/or 54 to secure the sifter 34 onto the container mouth 32 and the peel-away liner 42 onto the upper surface 38 of the sifter 34. If glue or pressure sensitive materials are used, then the appropriate application/activation technique must be used. A heat activated seal is preferred generally since it will insure that the layers 34 and 42 do not stick to the inside of the closure 12 and thereby eliminate the messiness and common problems associated with currently available sifter and liner assemblies. To further increase the sealing engagement between the closure 12 and the container mouth 32, a sealing bead can be included on the inside surface 66 of the top panel 14.

Figure 7:
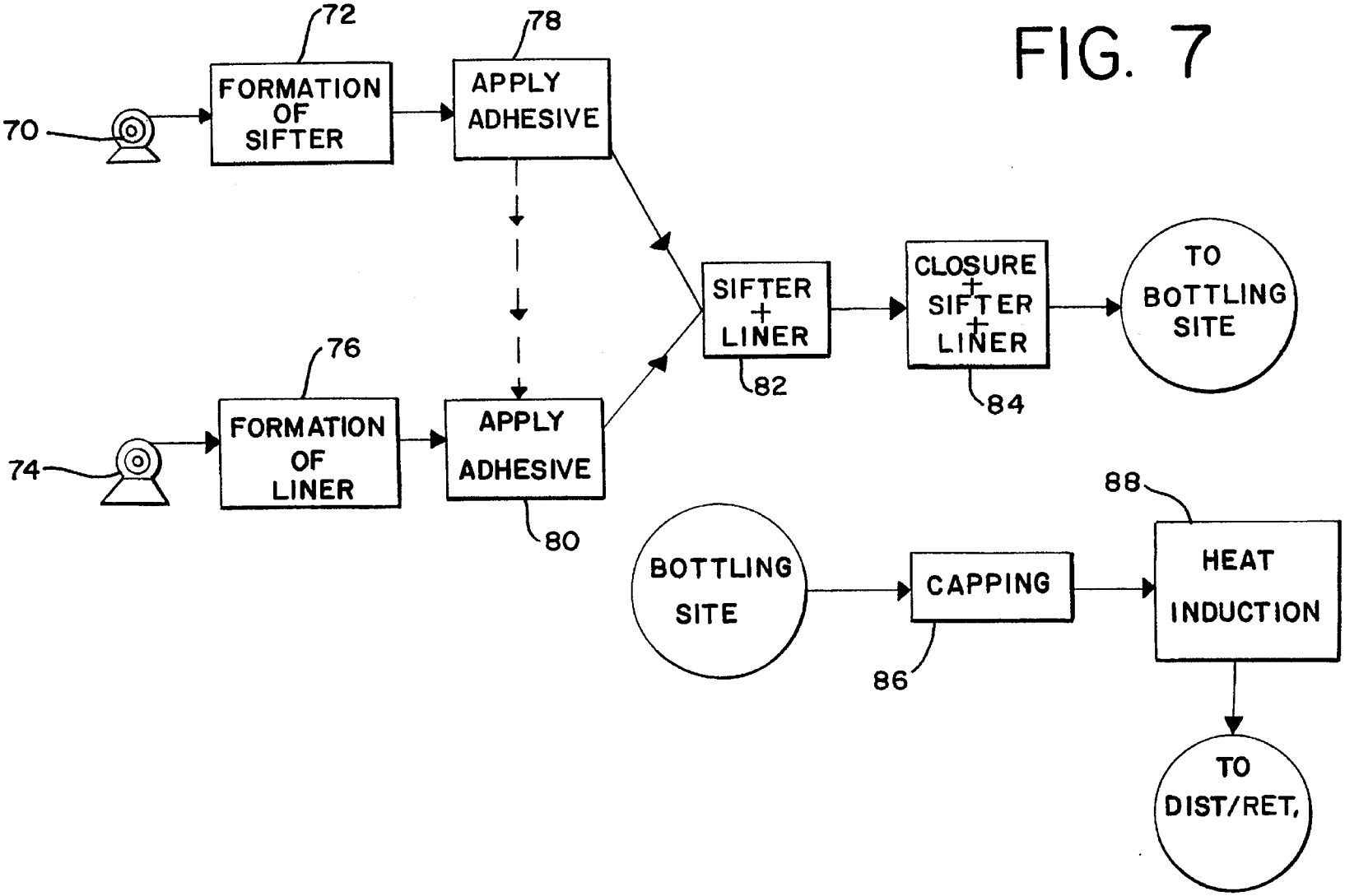
FIG. 7 is a schematic diagram depicting the steps involved in the method of making and applying the present invention.

Referring now specifically to FIG. 7, the present invention 10 also includes the method of making and applying the package 60 and closure 12 to a container 20. This method entails several steps which are outlined herein, but the exact sequence of steps can be altered or redirected without departing from the scope of the present invention.

For purposes of description only, the first step entails the formation of the sifter 34 from the web of given material 70 fed through the machinery 72 which can use commonly applied techniques, such as punching, cutting, molding or other techniques used in the industry. As shown in FIG. 3, the sifter 34 is formed having a diameter $D_2$ substantially equal to the diameter $D_1$ of the container mouth 32. It is contemplated, however, that the sifter 34 could be formed of a diameter $D_2$ which is slightly larger than the diameter $D_1$ of the container mouth 32 in order to provide a more secure engagement between the closure cap 12 and the container neck 22. As shown in the several figures, the sifter 34 will typically take on a circular shape, since most containers utilize a circular mouth portion. However, the sifter 34, as with the peel-away liner 42 need not be circular in shape, since other configurations are more applicable to particular applications. Simultaneous with, or soon after the formation of the sifter 34, the apertures 40 (FIG. 2) are formed through the sifter 34. The size, shape, placement and number apertures 40 may vary depending on the product being dispensed. It is also contemplated that the apertures 40 could be preformed through the web 70 of the given material chosen for the sifter 34.

Referring to FIGS. 2, 6 and 7, the peel-away liner 42 will also typically be formed through commonly used techniques, such as punching, cutting or molding. Since the tab 48 is formed integrally with the layer 42, the manner of forming the liner 42 must include the ability to punch, cut or mold the tab 48. The liner 42 is also formed from a given web 74 of the particular material selected. The web 74, as with web 70, is fed through the particular punching, cutting or molding machinery 76. The diameter $D_3$ of the peel-away liner 42 should be made substantially equal to the diameter $D_2$ of the sifter 34. The diameter $D_3$ can be smaller than diameter $D_2$ of the sifter 34, but if the diameter $D_3$ is larger than the diameter $D_2$ of the sifter 34, then the peel-away liner 42 may obstruct the application of the package 60 into the closure cap 12 or interfere with the proper application of the present invention 10 or package 60 by the bottler.

Typically, the material 70 for forming the sifter will already have applied to it from the manufacturer of the material, the adhesive coatings 52 and 54. However, it may be found more advantageous to apply the coatings 52 and 54 separately for manufacturing reasons. If the latter is the case, then as shown in FIGS. 5–7, once the sifter 34 and peel-away liner 42 have been formed, the next step is to coat the sifter 34 and/or the peel-away liner 42 with the adhesive materials. Again, the exact sequence of applying the adhesive material is not critical, and the following description is not intended to be a limitation on the scope of the invention. Accordingly, at station 78 a permanent or aggressive adhesive material is applied to the lower surface 36 of the sifter 34 to form a layer 50 of the permanent adhesive material, as shown in FIG. 6. At station 80 an impermanent or less aggressive adhesive material is then applied to either the upper surface 36 of the sifter 34 or the lower surface 44 of the peel-away liner 42. As depicted in FIGS. 5 and 6, the layer 54 of impermanent adhesive material will thereby be sandwiched between the sifter 34 and the peel-away liner 42.

At station 82 the sifter 34 and peel-away liner 42 are then aligned and stacked atop one another. If the impermanent adhesive layer 54 is other than heat activated or pressure sensitive type adhesive, then the sifter 34 and peel-away liner 42 will be secured to one another at this point, while the adhesive layer 50 on the lower surface 36 of the sifter 34 will retain its adhesive capabilities until the heat activation procedure. If the adhesive layer 54 is also of the heat activated type, then the sifter 34 and peel-away liner 42 will typically be held together through friction or the natural adhesive properties of the given material prior to the introduction of the particular heat technique.

Once the sifter 34 and peel-away liner 42 have been placed together, there is formed a transportable package 60, as shown in FIG. 4, which can then be easily placed into the retaining area 62 of the closure 12 to form the present invention 10. Accordingly, the next step in the assembly process is to provide a closure 12 and fit into its retaining area 62 the package 60, such as what occurs at station 84. Once the closure 12 has had the package 60 mounted within its retaining area 62, it can then be stored, sold and transported as a single unit to the bottler.

Referring to FIGS. 3 and 7, at the bottling site, the present closure 10, having package 60 within its retaining area 62, is applied to a container 20, which has been previously filled with a given granular or liquid product. Typically, the closure 12, being of a screw-on or snap-on type, will be screwed on or snapped onto the container 20 by the appropriate bottling machinery 86. Once the closure 12, having the package 60, has been secured to the container 20, the container 20 is passed through a heat induction unit 88.

Typically, induction heating is created by the application of a nominally electrical conducting material by Eddy currents induced by a varying electro-magnetic field. Induction heating is commonly employed as a means for hardening, annealing, tempering, or other such applications. Because the heating is induced directly into the material it is an extremely rapid method of heating that is easily controllable and lends itself to automation, in-line processing and automatic process cycle control. See generally, E. J. Davis and P. G. Simpson, *Induction Heating Handbook,* 1978; P. G. Simpson, *Induction Heating: Coil and System Design,* 1960; C. A. Tudbury, *Basics of Induction Heating*, 1960. Note that heat conduction, which involves the flow of thermal energy through a substance by atomic or molecule interactions is also a method of actuating certain materials having adhesive properties. See generally, V. S. Arpaci, *Conduction Heat Transfer,* 1966; H. S. Carslaw and J. C. Jaeger, *Conduction of Heat in Solids*, 2nd ed., 1959; M. N. Ozisik, *Heat Conduction,* 1980.

The application of heat induction to the closure cap 12 activates the adhesive properties of the layers of adhesive material 50 and/or 54. Upon the activation of the adhesive properties of these layers, the sifter 34 becomes permanently secured to the annular lip 30 of the container 20, while the peel-away liner 42 becomes temporarily adhered to the upper surface 38 of the sifter 34. The container 20 is now ready for packaging and transportation to the given distributor or retailer.

While a preferred embodiment of the invention has been shown and described, it should be understood that there is no intent to limit the invention by such disclosure, but rather it is intended to cover all modifications and alternative constructions that may fall within the spirit and the scope of the invention as defined in the appended claims.

What is claimed is:

1. A sifter and liner assembly configured for use with a container for holding a desired contents and having a neck with an annular lip at an uppermost end of the neck defining a mouth, said sifter and liner assembly comprising:

a sifter dimensioned to span the mouth of the container, said sifter having an upper surface and a lower surface;

at least one aperture formed through said upper and said lower surfaces of said sifter, said aperture dimensioned to allow the egress of the contents of the container;

a liner dimensioned to cover said upper surface and said aperture of said sifter, said liner having a lower, covering surface and an upper, exposed surface;

a first securing means located on said lower surface of said sifter for securing said sifter to the lip of the container;

a second securing means located between said upper surface of said sifter and said covering surface of said liner for securing said sifter to said liner;

a cap having a top panel, an annular skirt depending peripherally from said top panel and means for releasable engagement onto the neck of the container, said top panel and said skirt defining an inner retaining area for retaining said sifter and said liner within said cap; and said sifter, said liner and said cap forming a package which can be stored, transported and applied to the container as a unit.

2. The assembly as defined in claim 1, wherein said first securing means is a layer of permanent adhesive material.

3. The assembly as defined in claim 2, wherein said sifter has a peripheral edge and said layer of permanent adhesive material is located solely along said peripheral edge of said sifter.

4. The assembly as defined in claim 1,,wherein said second securing means is an impermanent adhesive material which permits the liner to be peeled away from said sifter by the user.

5. The assembly as defined in claim 4, wherein said sifter and said liner each have a peripheral edge and said layer of impermanent adhesive material is located solely along said peripheral edge of said sifter and said liner.

6. The assembly as defined in claim 1,.wherein said sifter has a diameter which is slightly larger than the mouth of the container.

7. The assembly as defined in claim 1, wherein said cap includes an annular sealing bead integrally formed on an inner surface of said top panel, said sealing bead corresponding with the annular lip of the container.

8. A sifter and liner assembly configured for use with a container for holding a desired contents and having a neck with an annular lip at an uppermost end of the neck defining a mouth, said sifter and liner assembly comprising:

a sifter dimensioned to span the mouth of the container, said sifter having an upper surface and a lower surface;

at least one aperture formed through said upper and said lower surfaces of said sifter, said aperture dimensioned to allow the egress of the contents of the container;

a liner dimensioned to cover at least said aperture of said sifter, said liner having a lower, covering surface, an upper, exposed surface and an integral pull tab;

a layer of permanent adhesive material located on a peripheral edge of said lower surface of said sifter, said layer of permanent adhesive material securing said sifter to the lip of the container when induced to do so by the application of heat or pressure;

a layer of impermanent adhesive material located between said upper surface of said sifter and said covering surface of said liner for removably securing said liner to said sifter;

a cap having a top panel, an annular skirt depending peripherally from said top panel and means for releasable engagement onto the neck of the container, said top panel and said skirt defining an inner retaining area for retaining said sifter and said liner within said cap; and said sifter, said liner and said cap forming a package which can be stored, transported and applied to the container as a unit.

9. The assembly as defined in claim 8, wherein said sifter has a diameter which is slightly larger than the mouth of the container.

10. The assembly as defined in claim 8, wherein said cap includes an annular sealing bead integrally formed on an inner surface of said top panel, said sealing bead corresponding with the annular lip of the container.

11. The assembly as defined in claim 8, wherein said sifter is made of a semi-rigid foil material and said liner is made of a paper material.

12. The assembly as defined in claim 8, wherein said sifter is made of a paper material and said liner is made of a foil material.

13. A method of making a sifter and liner assembly which is configured as a unit with a closure cap for assembly on a container, the container is for storing a desired contents and having a neck with an annular lip at an uppermost end defining a mouth, the method comprising the steps of:

forming a sifter of a given diameter from a first web of a preselected material, said sifter having an upper surface and a lower surface and being formed with at least one aperture, said sifter being dimensioned to span the mouth of the container;

forming a peel-away liner of a given diameter from a second web of a preselected material, said liner having a first surface and a second surface and being dimensioned to substantially cover said sifter;

applying a layer of permanent adhesive material to said lower surface of said sifter such that said layer of permanent adhesive material substantially aligns with the annular lip of the container upon application of said sifter to the mouth of the container;

applying a layer of impermanent adhesive material to either of said upper surface of said sifter or said first surface of said liner;

aligning said liner on top of said upper surface of said sifter to form a unit consisting of said layer of permanent adhesive material, said sifter, said layer of impermanent material and said liner;

positioning said unit into a retaining area of said closure cap;

transporting the closure cap and said unit as an autonomous package to a given bottling site where the container is located;

positioning and applying the closure cap and said unit onto the mouth of the container;

applying a heat or pressure transfer medium through a top panel of the closure cap to induce at least the permanent adhesive material to adhere to the annular lip of the container; and packaging and shipping the container having the closure cap, sifter and liner applied thereon to a predetermined site.

14. The method as described in claim 13, further including the step of forming a pull tab integral with said liner.

15. The method as described in claim 13 further including the step of selecting an impermanent adhesive material having adhesive properties that are activated through the induction of heat.

16. The method as described in claim 13 further including the step of forming said at least one aperture with a diameter large enough to permit the controlled egress of the container contents.

17. The method as described in claim 13 further including the step of selecting a foil material as said first web and a paper material as said second web.

* * * * *